United States Patent [19]

Pauna

[11] Patent Number: 4,821,348

[45] Date of Patent: Apr. 18, 1989

[54] CONVERTABLE BED AND BATHROOM COMBINATION

[75] Inventor: Kenneth Pauna, Cloquet, Minn.

[73] Assignee: Richard Paterson, Brampton, Canada

[21] Appl. No.: 158,661 .

[22] Filed: Feb. 22, 1988

[51] Int. Cl.[4] ..... A61H 33/02; A61G 7/02

[52] U.S. Cl. ..... 4/547; 4/553; 5/90

[58] Field of Search ..... 4/538, 546, 547, 553, 4/554, 663, 664; 5/90

[56] References Cited

U.S. PATENT DOCUMENTS

| | | | |
|---|---|---|---|
| 1,730,547 | 10/1929 | Wallace . | |
| 2,220,482 | 11/1940 | Fuller . | |
| 2,396,992 | 3/1946 | Evans . | |
| 2,471,302 | 5/1949 | Boward | 4/547 |
| 2,486,371 | 10/1949 | Mankki . | |
| 2,589,592 | 3/1952 | Ocana . | |
| 3,015,110 | 1/1962 | Treand . | |
| 3,447,166 | 6/1969 | Gordon . | |
| 3,965,501 | 6/1976 | Bucher | 4/547 |
| 4,085,472 | 4/1978 | DiMatteo | 5/90 |
| 4,112,524 | 9/1978 | Johansson . | |
| 4,133,057 | 1/1979 | Rivetti . | |
| 4,237,561 | 12/1980 | Britton . | |
| 4,238,858 | 12/1980 | Malihart . | |
| 4,296,508 | 10/1981 | Moran . | |
| 4,554,690 | 11/1985 | Knapp | 4/601 |

*Primary Examiner*—Robert W. Jenkins

*Attorney, Agent, or Firm*—Kinney & Lange

[57] ABSTRACT

A combination bed, toilet, and bath for handicapped person includes a tub with a built-in toilet. Inflatable air bags or cushion are used to raise and lower the patient between resting positions and toilet and bathing positions.

36 Claims, 9 Drawing Sheets

Fig. 8G
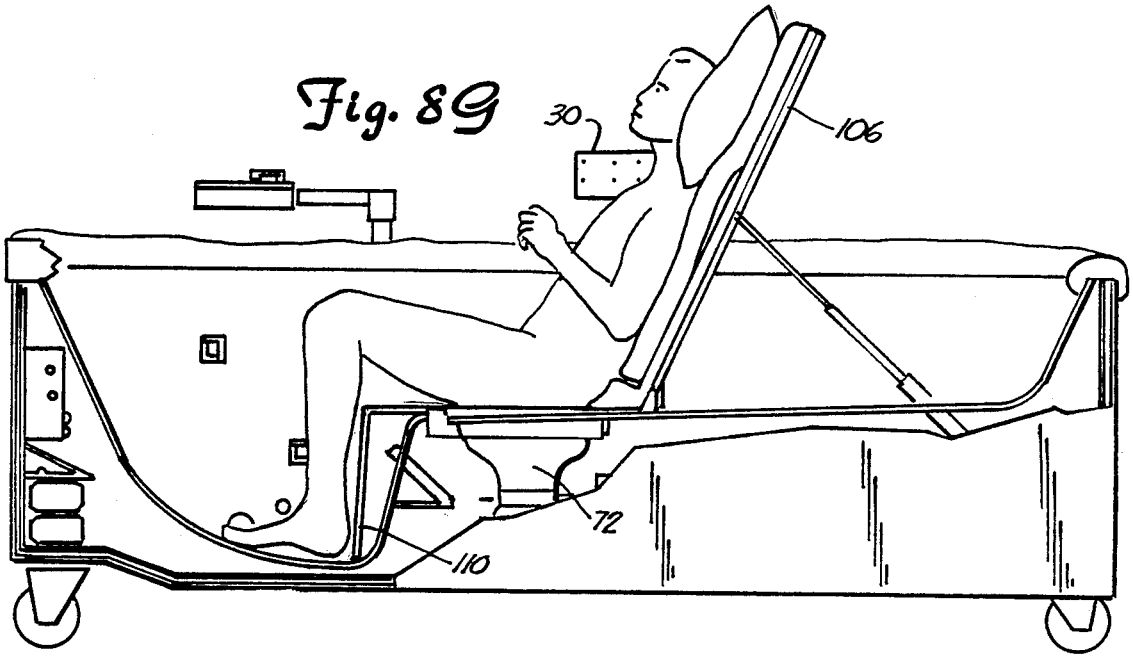
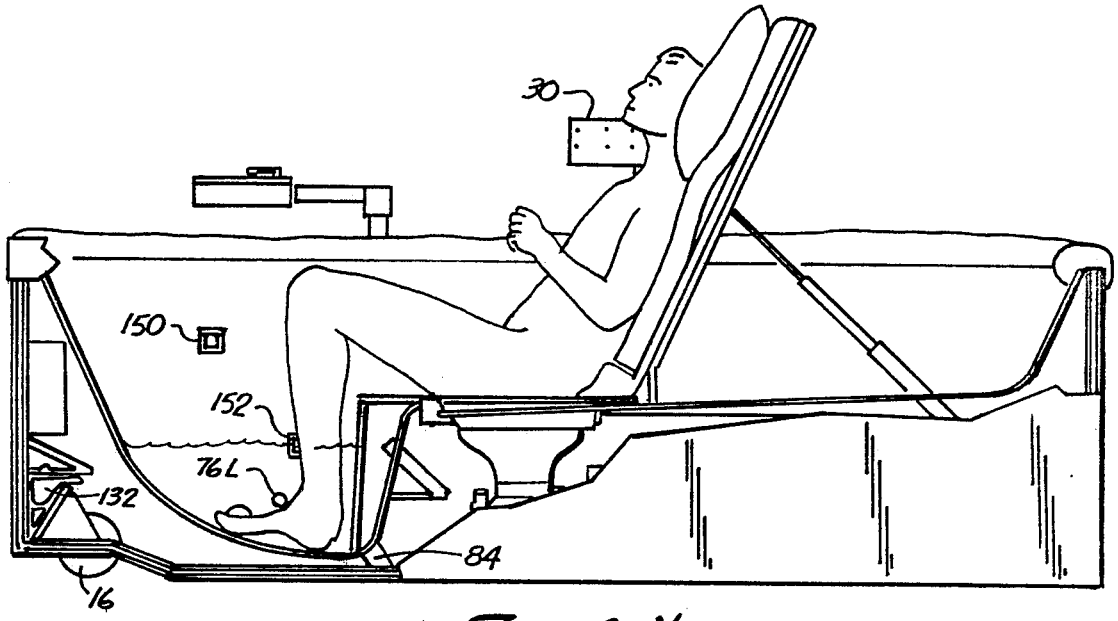
Fig. 8H

CONVERTABLE BED AND BATHROOM COMBINATION

BACKGROUND OF THE INVENTION

1. Field of the Invention

The present invention relates to a convertable bed and bathroom combination for helping an individual with limited mobility to become more independent.

2. Description of the Prior Art

The elderly, as well as the handicapped, often experience great difficulty in tending to personal hygiene and getting in and out of bed. There have been numerous attempts to combine bathroom features to aid convalescent patients. L. K. Gordon U.S. Pat. No. 3,447,166 combines a toilet with a shower such that an individual may be seated on the toilet and receive a shower while in the seated position. The apparatus is contained within a cabinet with doors through which the individual enters the cabinet. The Moran U.S. Pat. No. 4,296,508 provides a bathtub for invalids with a rotatable end part to assist the invalid in getting seated within the tub. Afterwards, the occupant-assisting feature lifts the individual out of the tub and pivots around, thereby providing a safe exit from the bathtub. The Johansson U.S. Pat. No. 4,112,524 discloses a shower bathtub combination with a toilet seat disposed above a collecting bowl. The shower water both washes the individual and provides a flushing medium for the collecting bowl to flush anything from the collecting bowl into a discharge conduit.

There is a continuing need for improved units to aid the elderly and the handicapped in becoming self-sufficient. One of the most difficult adjustments for many individuals who have been active throughout most of their life is the loss of self-sufficiency with advanced age or as a result of an accident, stroke, or other disabling illness or injury. The inability to do what previously had been common and simple tasks of personal hygiene can be very frustrating and demoralizing.

At the same time, the inability of an individual to move between bed and bathroom means that a great deal of personal care and attention is required for the individual's care. This increased level of attention falls upon family members or requires that the individual be cared for outside the home. In either case, this tends to increase the family's attendant time, financial obligations and stress. The individual often begins to see himself or herself as only a burden to the family.

SUMMARY OF THE INVENTION

The present invention is a multiple feature convertable system which permits a handicapped or elderly person to attend to personal hygiene with limited required movement. In preferred embodiments of the present invention, this system includes a tub with inflatable bags or cushions positioned within the tub for raising and lowering the person between bathing and toilet positions and resting (lying and sitting) positions. The system also preferably includes a toilet position within the tub which is opened to expose the toilet when the person selects the toilet function, and which is closed when the system is in bathing or resting position modes.

In preferred embodiments of the present invention, the tub has a multi-level interior surface with a leg well in which the individual's legs can be positioned and a higher elevation upper body region. A leg platform for supporting inflatable and knee support cushion is positioned within the leg well, and an upper body platform for supporting upper body cushions is positioned within the upper body region of the tub. The present invention also preferably includes means for moving the leg and upper body platforms to adjust the position of the individual within the tub. The platforms preferably are operably connected to each other and react to each other's motion to attain the proper position.

In still further embodiments of the present invention, the cover of the toilet is slidable between an open and a closed position, and is moved by drive means. Inflatable cushions surround the toilet seat, and a cushion is provided on the cover. When the individual selects a toilet mode of operation, the cushion on the cover is first deflated, the sliding cover is then moved to its open position, and the hip cushions surrounding the seat are deflated to lower the patient over the open toilet seat. At the same time, the position of the leg and upper body platforms are changed and cushions are inflated or deflated as appropriate to lower the patient onto the toilet seat in a generally sitting position.

BRIEF DESCRIPTION OF THE DRAWINGS

FIGS. 8A–8H illustrate operation of the present invention.

DETAILED DESCRIPTION OF THE PREFERRED EMBODIMENTS

Figure 1:
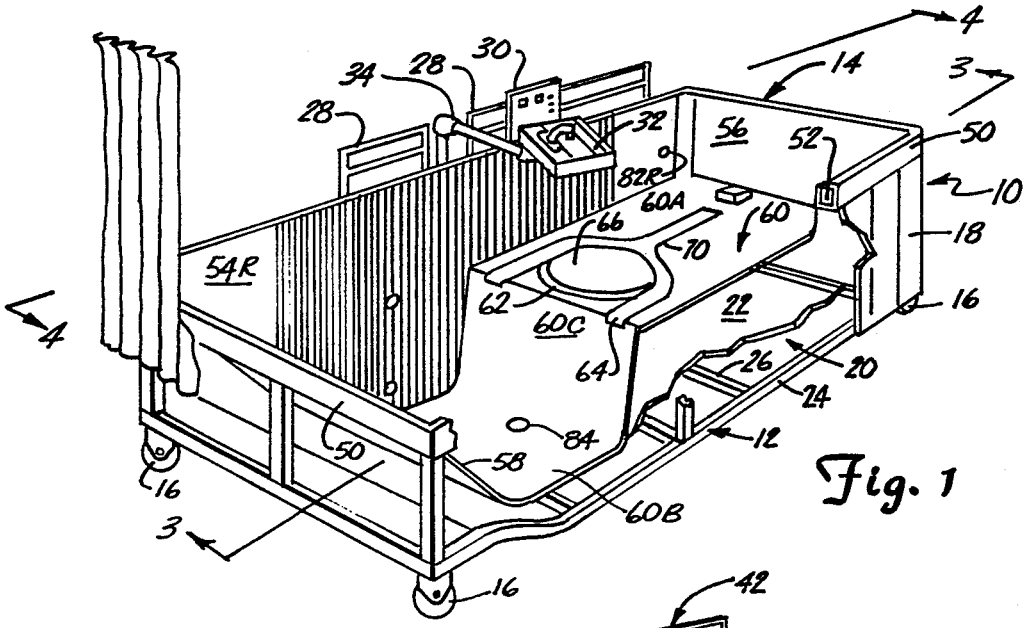
FIGS. 1 and 2 are perspective views, with portions broken away and with portions removed, of a preferred embodiment of the combination bed, bath, and toilet of the present invention.
Figure 2:
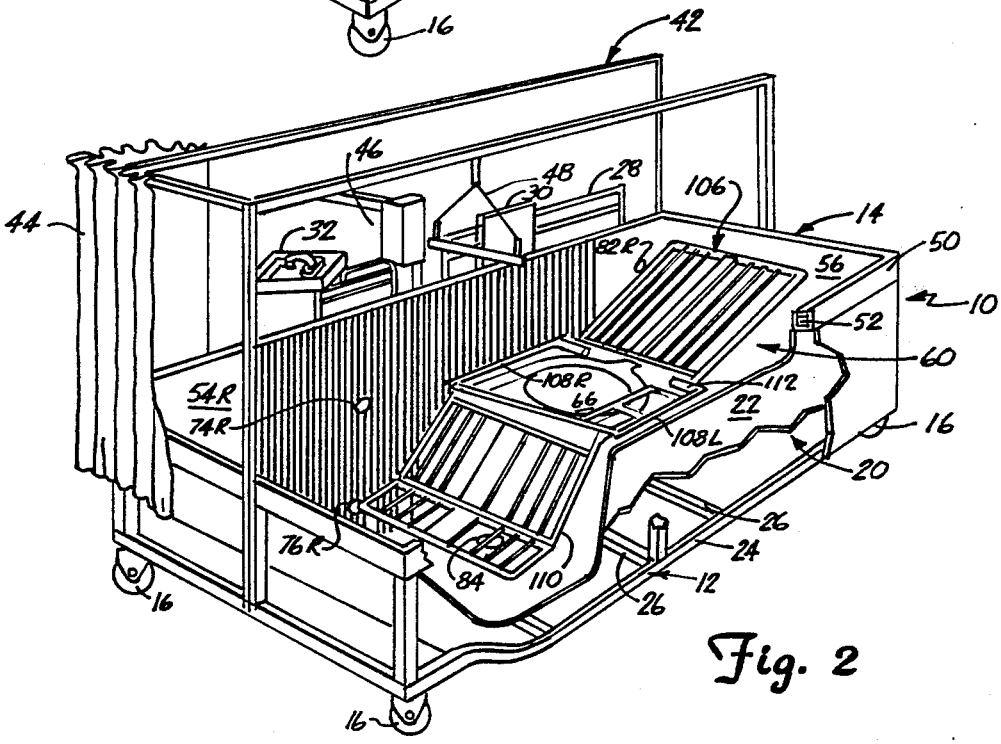

As illustrated in FIGS. 1 and 2, combination bed/-bathroom unit 10 includes metal tubular frame 12 which supports tub 14 (which is preferably molded acrylic plastic). Frame 12, which in one preferred embodiment is one inch square steel tubing which has been welded, primed, and painted so that it has corrosion resistant qualities, has retractable caster wheels 16 at its corners. When caster wheels 16 are in their "down" position, frame 12 is elevated above the floor, so that unit 10 can be rolled from place to place. When casters 16 are retracted, frame 12 is lowered directly onto the floor surface, so that the weight of unit 10 is supported directly by frame 12.

Figure 3:
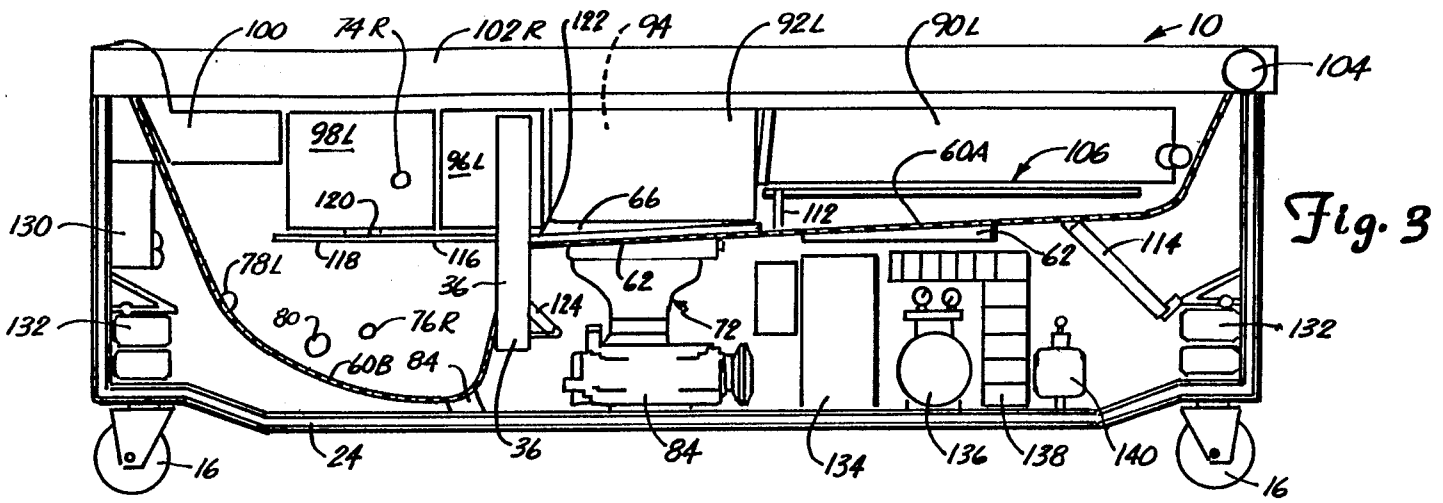
FIG. 3 is a sectional view, generally along section 3—3 of FIG. 1.
Figure 4:
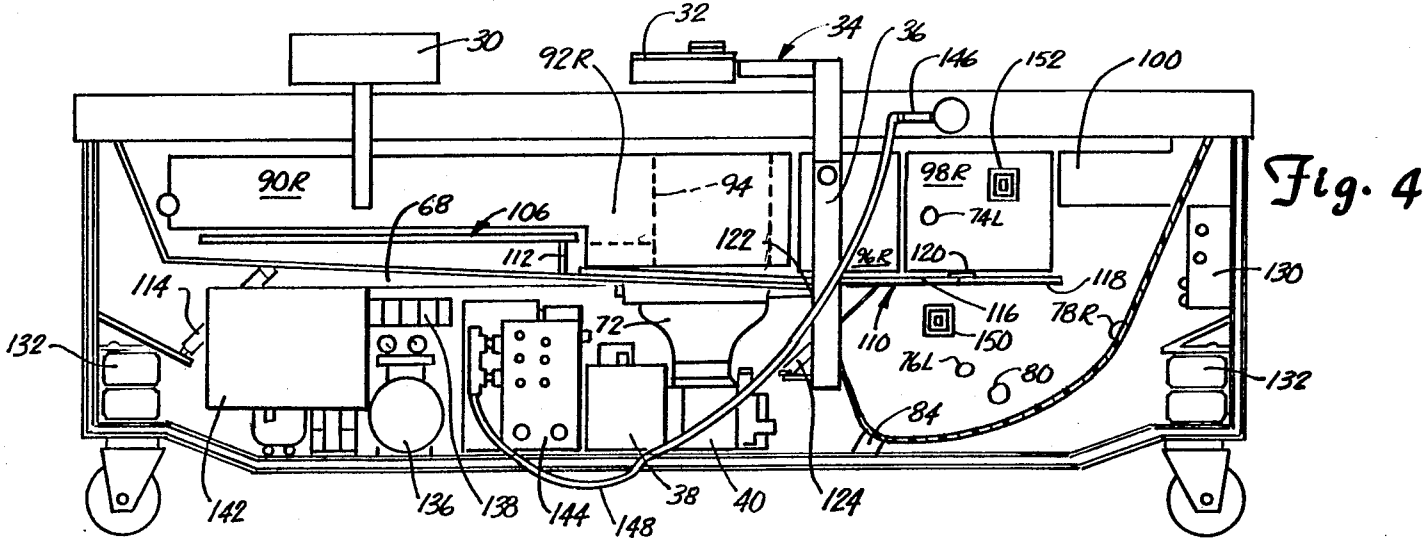
FIG. 4 is a sectional view, generally along section 4—4 of FIG. 1.

Outer panels 18 are mounted on frame 12, and preferably are removable to allow access to the equipment compartment 20. In FIGS. 1 and 2, portions of frame 12, tub 14, and outside walls or panels 18 have been broken away for illustrative purposes. The components normally located within equipment compartment 20 are not shown in FIGS. 1 and 2, but are illustrated in FIGS. 3 and 4.

Floor 22 is located in equipment compartment 20 and is preferably a plastic material or fiberglass molded to rest on lower side rails 24 of frame 12 and then drop inside as far as the bottom of rails 24. This creates a drip pan to catch any condensation from the bottom surfaces of tub 14 or the plumbing mounted below tub 14. Floor 22 also is molded over cross members 26 of frame 12 to protect those members from any moisture.

Mounted alongside tub 14 are guard rails 28. Also mounted on one (either) side of unit 10 is patient control panel 30, which is preferably a touch responsive panel which uses membrane pneumatic operation switches to insure absolute safety. This allows control panel 30 to be enclosed so that is not affected by moisture.

Hand sink 32 is supported by ratchet swinging arm 34, which in turn is pivotally attached to one of two personal sink attachment arms 36 (FIGS. 3 and 4) on opposite sides of unit 10. Each of the attachment arms 36 is provided with necessary plumbing connections for sink 32. Sink 32 is preferably is slightly larger than thirteen inches square, and is equipped with hot and cold water and a drain system which drains into discharge container 38 (FIGS. 4 and 6) located in equipment compartment 20. Inside container 38 is a float connected to a relay switch which controls the operation of discharge pump 40 for discharging waste water. This drain water discharge system for sink 32 operates automatically. Sink 32 is not designed to hold any water, but to make running water available for light uses such as rinsing hands or brushing teeth.

As illustrated in FIG. 2, an optional light weight frame 42 can be attached to main frame 12 for supporting curtains 44, heat lamp 46, trapeze bar 48 and other items requiring support from above, such as lights.

Tub 14 has an upper lip 50 which is mounted over top rails 52 of frame 12, so that tub 14 is suspended above compartment 20. The interior of tub 14 has a pair of generally vertical side walls 54L and 54R, a generally vertical head end wall 56, and a sloped and downwardly extending foot end wall 58. Bottom 60 of tub 14 has an upper body section 60A and a foot well section 60B, which are connected by a generally vertical intermediate section 60C.

Toilet seat 62 is an integral molded part of tub 14, and is positioned near the junction of bottom sections 60A and 60C. Surrounding toilet seat 62 is channel 64. Toilet seat 62 preferably has about an eight degree angle from horizontal, with the portion closest to head end 56 being lowest.

Toilet seat cover 66 slides back and forth over toilet seat 62. The position of toilet seat cover 66 is controlled by rodless air cylinder 68 (FIG. 3). Seat cover 66 is normally positioned over toilet seat 62 and has a seal on its underside. During bathing, the patient sits on seat cover 66, which ensures a good water tight seal between cover 66 and seat 62. When toilet activities are required, cylinder 68 (which is mounted in recess 70) is actuated to retract seat cover 66 from toilet seat 62, which exposes the interior of toilet 72.

In a preferred embodiment of the present invention, toilet 72 is a mascerator/pump system which is supported over floor 22 within equipment compartment 20. The upper rim of toilet 72 is mounted against the underside of tub 14, below seat 62, with a sealant between the two.

Mounted in the side walls and end walls of tub 14 are directional water jets 74R and 74L, 76R and 76L and 78R and 78L, water suction intakes 80, and water air ports 82R and 82L. In the bottom foot well section 60B is tub drain 84. Water jets 74R, 74L, 76R and 76L, supply water to fill tub 14, and are connected to pump 84 (FIG. 6) to form a water circulation whirl-pool system. In addition, jets 74R and 74L, 76R and 76L, 78R and 78L and 82R and 82L are connected through control valves to supply heater 134 warm air to keep the patient warm and to dry patient at the end of the bath.

Combination bed/bathroom unit 10 of the present invention uses inflatable air cushions or bags to raise and lower the patient between resting (lying and sitting) positions and toilet and bathing positions. In order to show other elements of combination unit 10, the inflation cushion is not shown in FIGS. 1 and 2.

Figure 5:
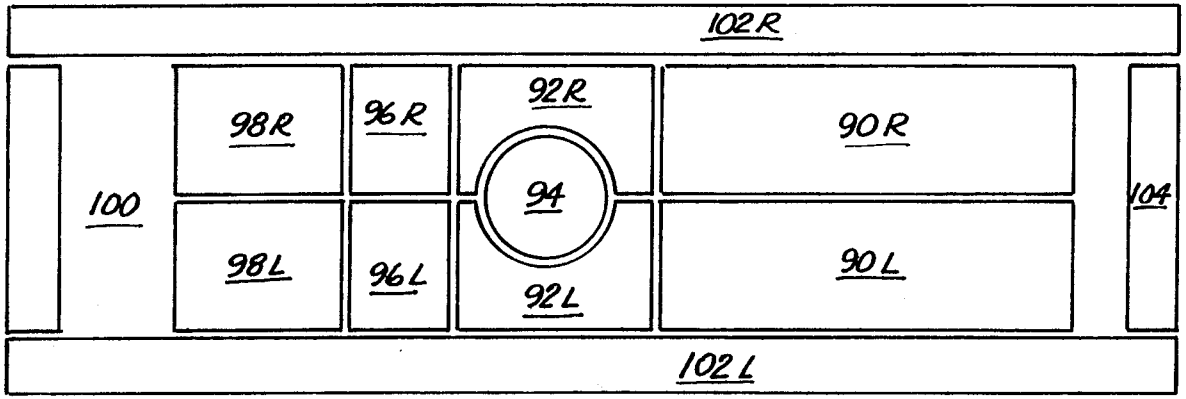
FIG. 5 is a top view of the combination bed, bath and toilet.

As shown in FIGS. 3, 4, and 5, the inflation cushions include right shoulder cushion 90R, left shoulder cushion 90L, right hip cushion 92R, left hip cushion 92L, center lift cushion 94, right knee cushion 96R, left knee cushion 96L, right leg support cushion 98R, left leg support cushion 98L, heel support cushion 100, right bumper cushion 102R, left bumper cushion 102L, and head bumper cushion 104.

The inflation cushions within tub 14 are supported above bottom 60 by upper body platform 106, right hip support platform 108R, left hip support platform 108L, and leg lift platform 110, as shown in FIGS. 2, 3, and 4. Upper body platform 106 is a grate formed of a corrosion resistant material such as stainless steel or acrylic plastic which is pivotally connected to support posts 112. The position of upper body platform 106 is controlled by air cylinder 114, which is mounted within compartment 20. Alternatively, cylinder 114 is replaced by two cylinders mounted within the bath unit lying horizontal on each side of upper level allowing toilet cover to pass between them.

Leg lift platform 110 has a thigh support section 116 and a calf support section 118 which are connected together by hinge 120. Thigh support section 116 is pivotally connected at pivot point 122 to tub 14. Air cylinder 124 controls the position of leg lift platform 110 and/or there can be cylinders mounted inside of bath unit to operate leg lift platform and thigh support platform.

FIGS. 3 and 4 show the placement of various components within equipment compartment 20. For ease of illustration, connections between various components are not illustrated, but will be described in more detail in FIGS. 6 and 7.

In FIG. 3, at the foot end of unit 10 within compartment 20 is attendant's control panel 130. This control panel includes similar functions to the ones provided by patient control panel 30, and also provides capability of "locking out" patient control panel 30 so that only control signals from attendant's control panel 130 can operate unit 10. Alternatively, a combination of both control panels 30 and 130 is provided in one unit where the attendant panel is on the backside of the user's panel.

Each caster 16 has a set of air springs 132 associated with it. When air springs 132 are inflated, as shown in FIGS. 3 and 4, the casters 16 are "down". When air springs 130 are deflated, casters 16 pivot inwardly and retract, so that the unit will rest on side rails 24 and cross rails 26 of frame 12. Immediately below toilet seat 62 is toilet unit 72. Along side toilet unit 72 in FIG. 3 is water massage circulating pump 84.

Located generally below platform 106 within compartment 20 are heater 134, vacuum/pressure pump 136, air control valves 138, and high pressure air pump 140. Heater 134 is preferably an extractor of heat from hot water—so that there is no electric coil to short out. Vacuum/pressure pump 136 is connected through control valves 138 to the inflation bags to inflate and deflate the bags depending upon the control command provided from either user control panel 30 or attendant's control panel 130. High pressure pump 140 is also connected to control valves 138, and provides the air pressure for operating air springs 132, toilet seat cover cylinder 68, and platform control cylinders 114 and 124.

Additional components shown in FIG. 4 include electrical control housing 142 (which houses all of the electrical control circuitry), intake water manifold 144, float-controlled sink water discharge chamber 38, discharge pump 40, hand held personal shower device 146, (which is connected to manifold 144 by flexible tubing 148), and water level sensing relays 150 and 152.

Figure 6:
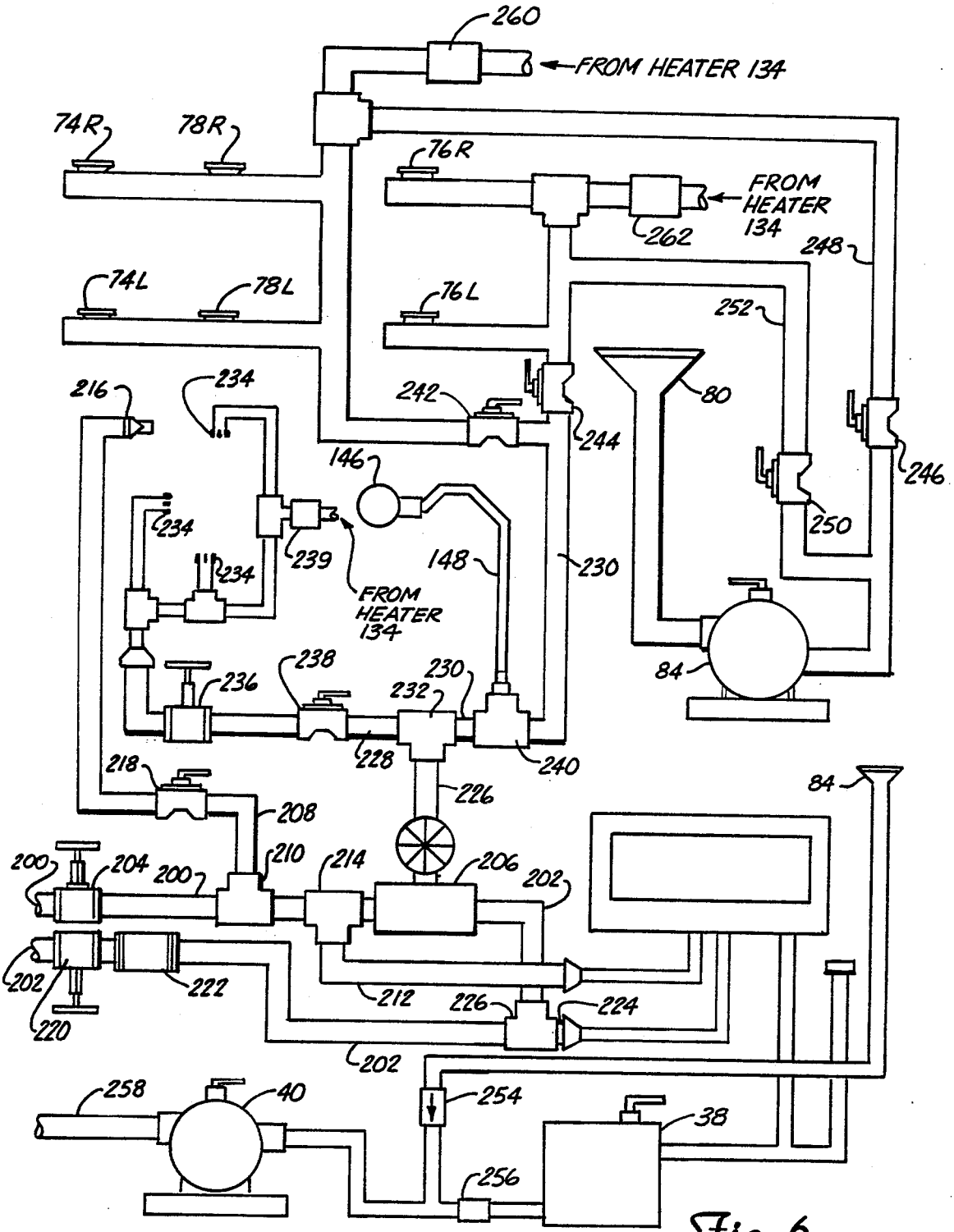
FIG. 6 is a schematic diagram showing the water intake, circulation, and drain system of the apparatus of the present invention.

The water intake, circulation, and drain system of unit 10 is shown schematically in FIG. 6. All values shown in FIG. 6 preferably are housed inside of a clear plastic manifold, water flow and direction is visable. Water is supplied to the system through cold water intake line 200 and hot water intake line 202. Manually operated shut off valve 204 is connected in cold water line 200 at the point of entry on line 200 into unit 10. Cold water is supplied through line 200 to water temperature mixing valve 206. Toilet flush line 208 branches off from cold water line 200 at T connector 210, and sink cold water line 212 branches off from line 200 at T connector 214. Toilet flush line 208 provides cold water to flush nozzle 216 of toilet 72. The flow of water to nozzle 216 is controlled by pneumatic toilet flush control valve 218 in toilet flush line 208.

Hot water line 200 has manually controlled shut off valve 220 at its inlet end, followed by check valve 222. Line 202 is connected to water temperature mixing valve 206. Sink hot water line 224 branches off from main hot water line 202 at T connector 226. Check valve 222 prevents cold water from mixing valve 206 from backing into hot water lines.

Mixing valve 206 selects the ratio of cold and hot water to provide a desired water temperature for bathing, showering, and for personal washing during use of the toilet. At mixing valve 206, the mixed water branches in three directions. Mixed water outlet line 226 branches into personal wash line 228 and bath line 230 at T connector 232. Personal wash line 228 supplies water to three wash nozzles 234 which are located within toilet 72 below toilet seat 62 and which spray on the underside of the patient to clean the patient after toilet 72 has been flushed. Manually controlled shut off valve 236 and pneumatic valve 238 are connected in the personal wash line 228. After spraying water through nozzles 234, valve 238 is closed and pneumatic valve 239 opened to allow air from heater 134 to dry the patient.

The hand held personal shower 146 is connected through flexible conduit 148 to T connector 240, which is connected in line 230. A hand controlled valve within hand held personal shower 146 controls flow of water through line 148 and out through personal shower 146.

As shown in FIG. 6, line 230 supplies water to directional water jets 74R and 74L and 78R and 78L in the upper bath area and directional water jets 76R and 76L in the foot area of tub 14. Flow of water through line 230 to jets 74R, 74L, 78R and 78L is controlled by pneumatic valve 242. Flow of water to water jets 76R and 76L is controlled by pneumatic valve 244.

A whirlpool system is incorporated into unit 10 to provide a gentle massage while bathing. Water is circulated by pump 84, which draws in bath water through intakes 80. Pump 84 discharges water to water jets 74R, 74L, 78R, 78L through pneumatic valve 246 and line 248, and supplies water to foot area directional water jets 76R and 76L through pneumatic valve 250 and line 252.

The bath water drain system is set up to operate without the need for drain stops. Water flows down through tub drain 84 and check valve 254 to discharge pump 40. Similarly, the outlet of float-controlled sink water discharge container 34 is connected through check valve 256 to pump 40. To discharge fluid to sanitary line 258, pump 40 is activated by touching the proper command switch on panel 30 or 130.

After the bath, it is important to keep the user warm and to dry the user as soon as possible. Hot air from heater 134 is provided through pneumatic valve 260 to directional water jets 74R, 74L, 78R, and 78L, which also act as air nozzles during the drawing sequence. Similarly, air from heater 134 is provided through pneumatic valve 262 to foot area directional water jets 76R and 76L. At the opposite end of tub 14, air is also being provided by heater 134 through pneumatic valve 263 (FIG. 7) to air nozzles 82R and 82L.

Figure 7:
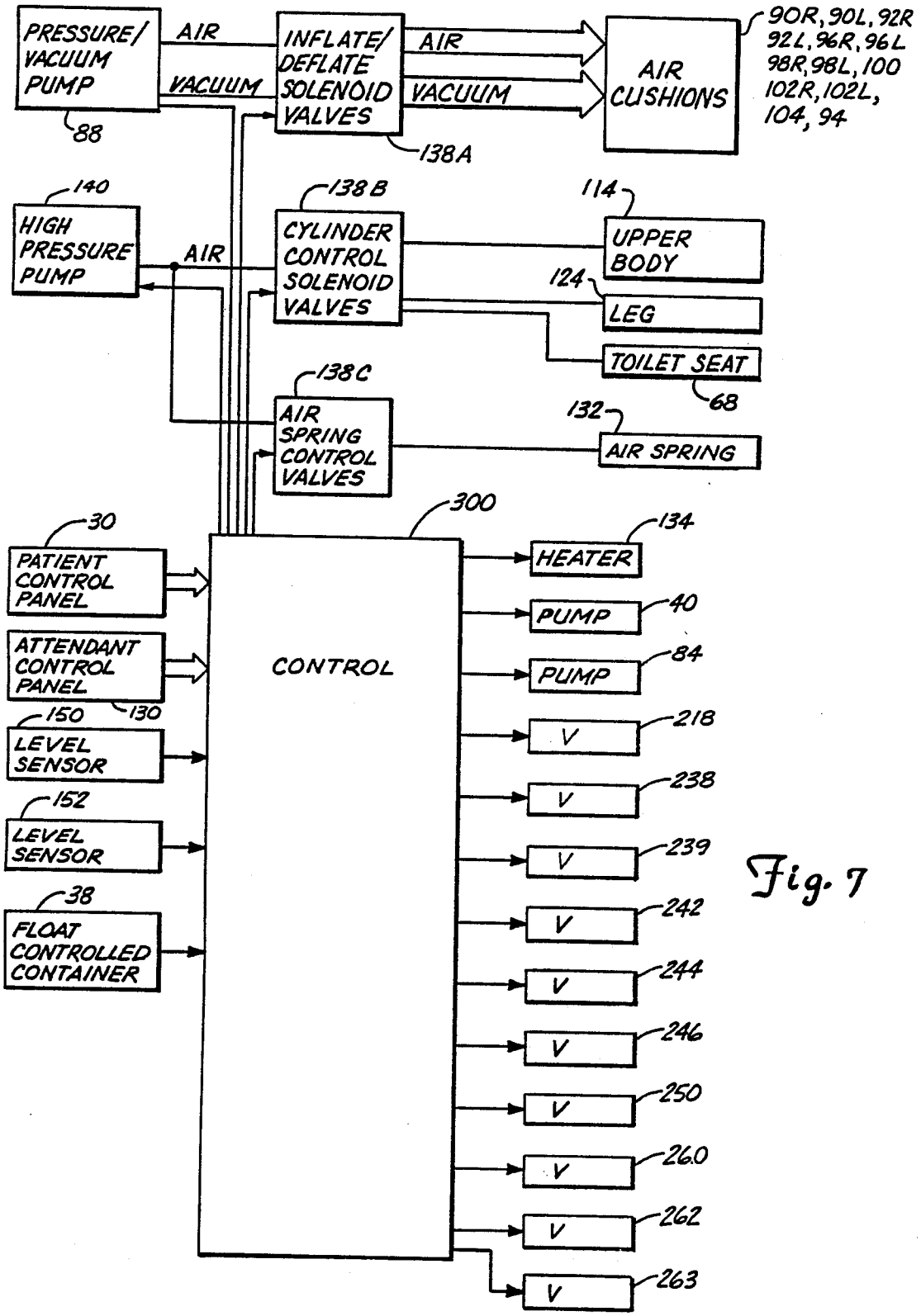
FIG. 7 is a schematic diagram showing the control system of the apparatus of the present invention.

FIG. 7 shows a block diagram of the control system or unit 10 of the present invention. As shown in FIG. 7, operation of unit 10 is coordinated by pneumatic control 300, which receives inputs from patient control panel 30, attendant control panel 130, level sensors 150 and 152, and the float sensor of float-controlled discharge container 38. In one embodiment, pneumatic control 300 uses relay logic to perform the sequenced operations commanded from patient control panel 30 and attendant control panel 130. In another embodiment, pneumatic control 300 includes a programmed microprocessor control.

As shown in FIG. 7, pneumatic control 300 provides control signals to inflate/deflate pneumatic valves 138A, cylinder control pneumatic valves 138B, and air spring control valves 138C. Pressure/vacuum pump 86 provides air and vacuum to valves 138A which allows the air cushions to either be inflated or deflated. Valves 138A are three-way valves, so that air pressure can be applied, a vacuumm can be applied, or the existing air pressure or vacuum can be held. The control signals from pneumatic control 300 select the state of each of the valves associated with each of the air cushions.

High pressure pump 140 provides air to cylinder control pneumatic valves 138B and air spring control valves 138C. The cylinder control pneumatic valves 138B are connected to upper body platform air cylinder 114, leg lift platform, air cylinder 124, and toilet seat air cylinder 68, each of which is a double acting air cylinder. The signals from pneumatic control 300 to valves 138B individually control the actuation of cylinders 68, 114, and 124.

Air spring control valves 138C control air from high pressure pump 140 to air springs 132. When high pressure is applied to air springs 132, caster wheels 16 are lowered, and unit 10 can be rolled from place to place. When the air is withdrawn from air springs 132, caster wheels 16 pivot inward to lower the frame onto the floor.

Pneumatic control 300 also controls operation of pumps 40 and 84 and pneumatic valves 218, 238, 239, 242, 244, 246, 250, 260, 262, and 263. The operation of the various pneumatic valves and pumps are controlled based upon inputs from control panels 30 and 130, and are coordinated with the operation of the inflation/deflation system which raises and lowers the patient.

FIGS. 8A–8H illustrate the operation of unit 10 in converting from one mode to another. In this particular case, the patient begins in a horizontal rest position in FIG. 8A, and ends in a sitting position in position 8H, with a foot-only water massage being applied. In the interim, the patient has made use of toilet 72.

Unit 10 shown in FIGS. 8A–8H includes one additional inflatable cushion (top mattress 350), which over lies cushions 90L and 90R, 92L and 92R, 96L and 96R, and 98L and 98R. Top mattress 350 has a central opening over center seat cushion 94.

Figure 8A:
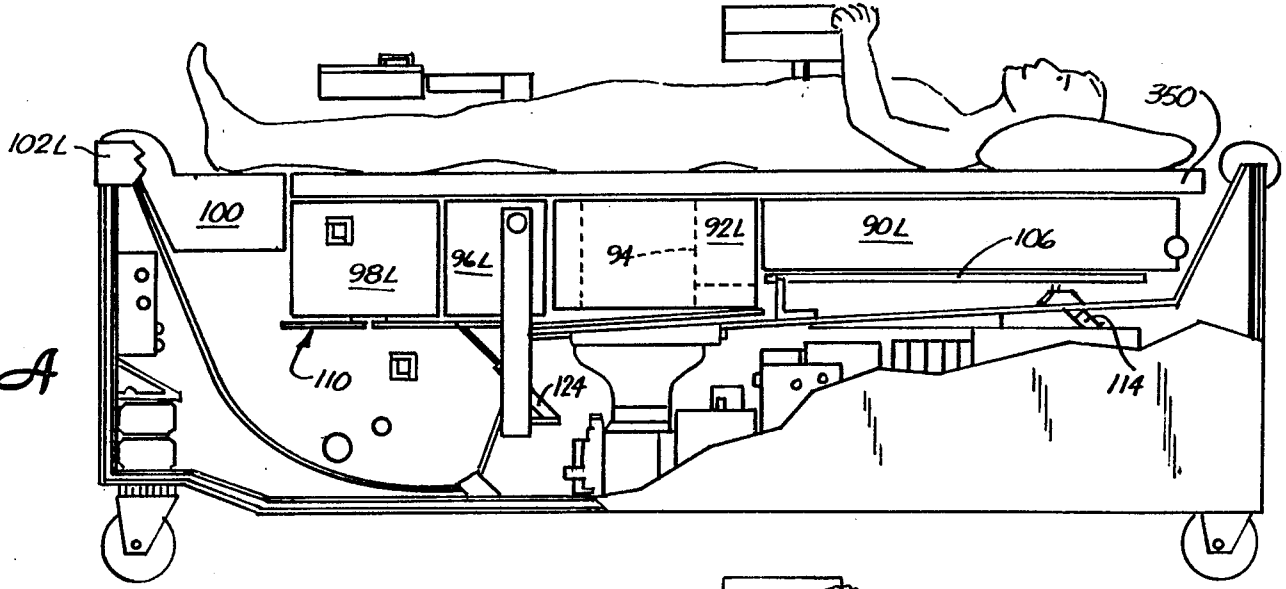

In FIG. 8A, all cushions are essentially fully inflated, and platforms 106 and 110 are in generally horizontal positions. This results in a generally horizontal rest position for the patient.

When the patient (or the attendant) selects the toilet function by touching the appropriate switch of control panel 30 (or control panel 130), the toilet sequence begins under the control of pneumatic control 300.

Figure 8B:
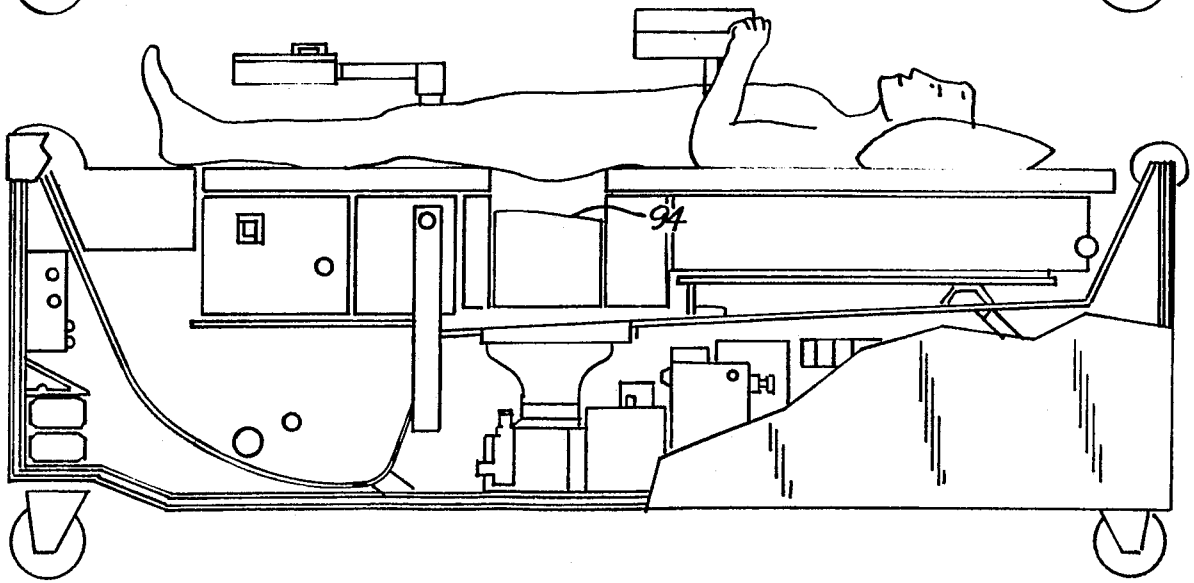

As shown in FIG. 8B, center cushion 94 begins to deflate first, while all of the remaining cushions are still fully inflated. The inside perimeter of hip bags 92L and 92R and knee bags 96L and 96R hold the patient up while center bag 94 is deflated.

Figure 8C:
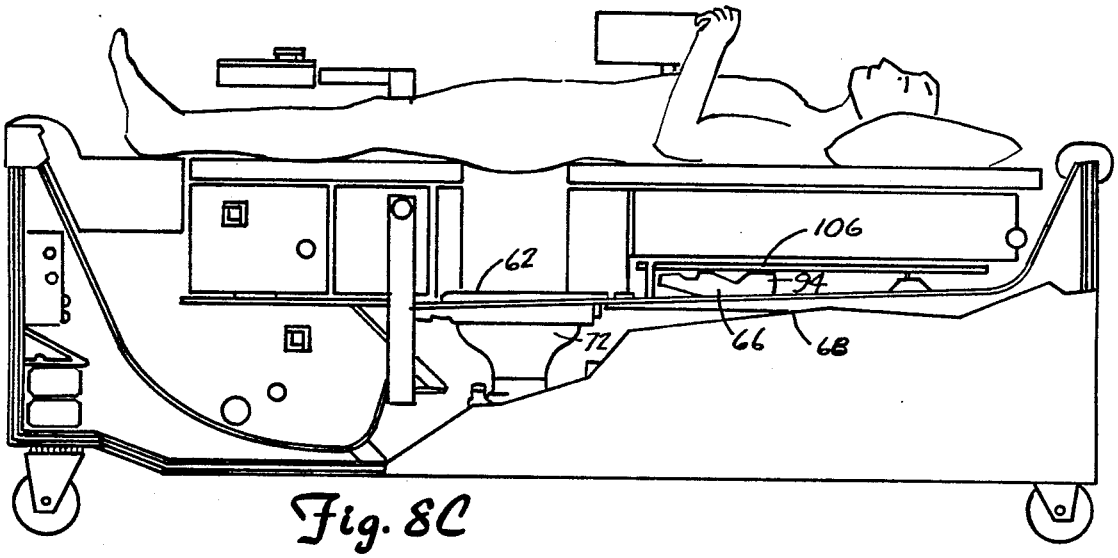

In FIG. 8C, center bag 94 is fully deflated and has been moved, along with toilet seat 66 to a position below platform 106 by toilet air cylinder 68. Toilet seat cover 62 is exposed and toilet 72 is opened and ready for the patient to be lowered.

Figure 8D:
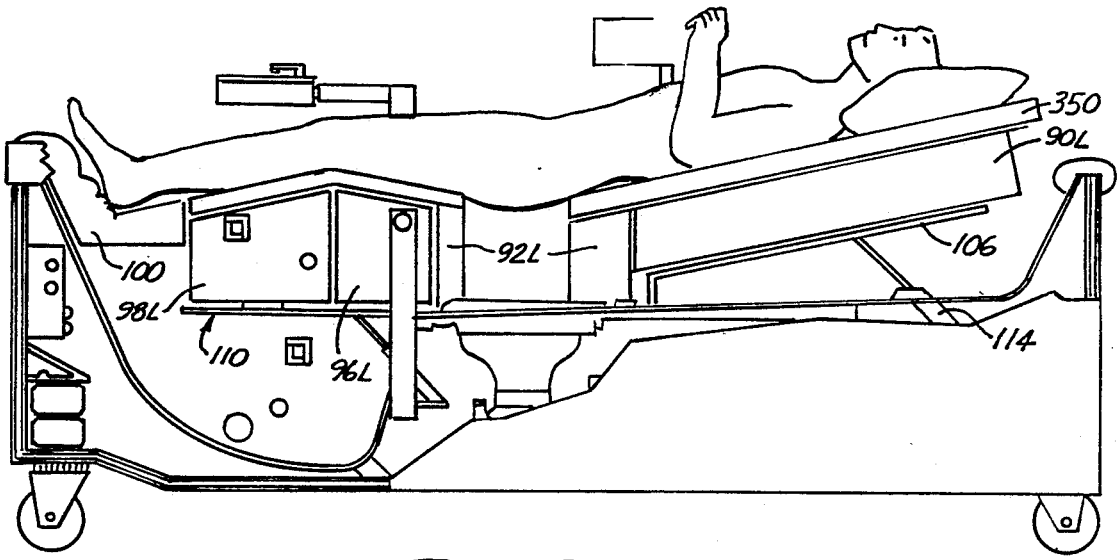

FIG. 8D shows unit 10 as the patient begins to be lowered. In this position, heel bag 100, leg bags 98L and 98R, knee bags 96L and 96R and hip bags 92L and 92R begin to deflate. Platform 110 is still horizontal, but platform 106 is beginning to be raised by air cylinder 114.

Figure 8E:
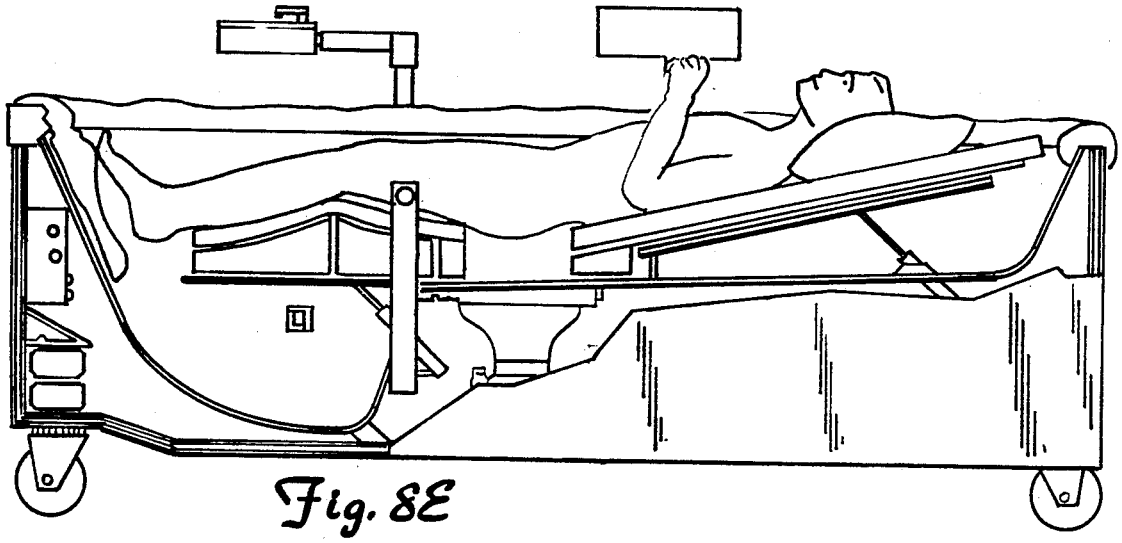

In FIG. 8E, upper body cushion 90L and 90R have been fully deflated while bags 92L, 92R, 96L, 96R, 98L and 98R remain partially inflated so that the knees are kept well supported and elevated. This keeps the patient from sliding forward as patient is lowered toward the toilet 72. Top mattress 350 is kept nearly fully inflated at this point to maintain a secure feeling for the patient.

Figure 8F:
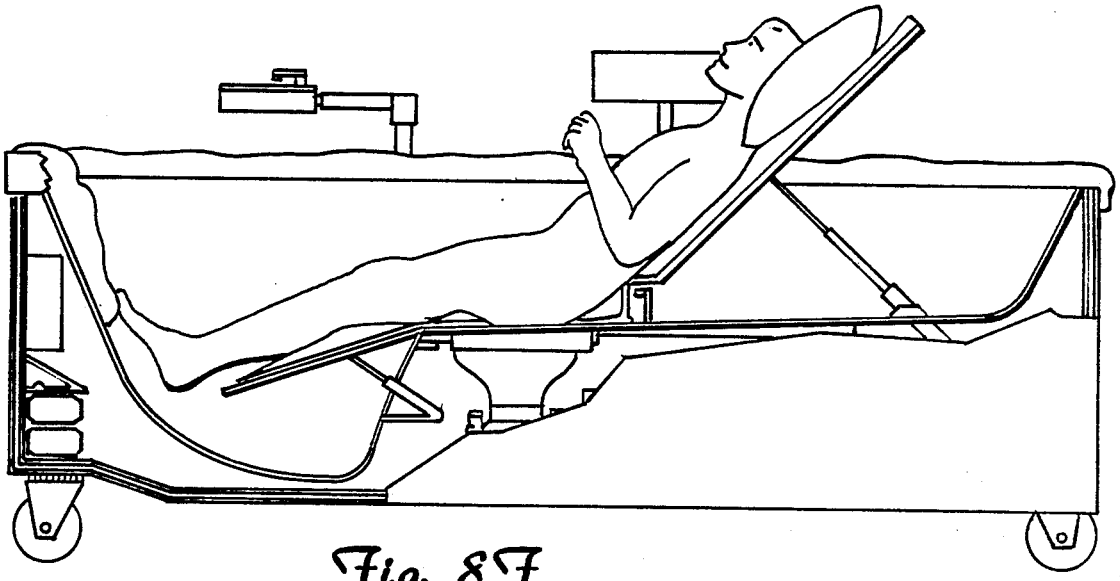

In FIG. 8F, platform 110 has begun to lower, while platform 106 has been raised to approximately a 45 degree angle. At this point, complete seating contact between the patient and toilet seat 62 has been made. The 8 degree angle from horizontal made by the toilet seat 62 accommodates the patient without putting pressure on the tail bone area. At this point, all of the air bags within the tub 14 are deflated. Only bumper cushions 102L, 102R, and 104 remain inflated.

In FIG. 8G, platform 110 has been fully lowered, while platform 106 has been raised to a maximum of about 60 degree angle from horizontal. The patient, upon completing use of toilet 72, presses an appropriate switch on panel 30, which causes flushing of toilet 72, the spraying of water from jets 234, followed by the blowing of warm air from heater 134 through jets 234 to dry off patient.

Finally, in FIG. 8G, the patient has selected a foot massage function in which the water jets 76L and 76R spray water into the foot well area. In response to the selection of the foot massage mode by the patient through panel 30 (or the attendant through panel 130), pneumatic valve 244 is opened allowing water to flow from mixing valve 206 through line 230 to foot area water jets 76R and 76L. This flow of water continues until level sensor 152 detects the presence of water. At that point, a signal is provided to pneumatic control 300 which closes pneumatic valve 244 and which opens pneumatic valve 250 and activates circulation pump 84 to operate the whirlpool system.

Also shown in FIG. 8H is the retracted position of caster wheels 16. As shown in the lower left hand corner of FIG. 8H, caster wheel 16 has pivoted inwardly and upwardly as a result of air being withdrawn from air springs 132.

Upon completion of the foot massage treatment (which may either operate for a fixed time period or may be terminated through an input from control panel 30 or 130), pump 84 is stopped, pneumatic valve 250 is closed, and discharge pump 40 is actuated to pump the water out through tub drain 84 into sanitary pipe 258. During this sequence, pneumatic valve 262 is opened, and hot air from blower 134 is supplied to jets 76R and 76L to dry the patient's lower legs and feet.

The process for returning the patient to the horizontal rest position shown in FIG. 8A generally follows in reverse of the steps illustrated in FIGS. 8A–8G.

The sequence for full body bathing is generally similar to the sequence shown in FIGS. 8A–8H, except that central cushion 94 is deflated at generally the same rate as the surrounding air cushions, and toilet seat cover 66 remains in place over toilet seat 62. As the patient is lowered onto toilet seat cover 66, the weight of the patient assists in providing a water tight seal between toilet seat cover 66 and toilet seat 62.

Although a fully horizontal resting position has been shown in FIG. 8A, a partially seated rest position is also possible by pivoting platform 106 from the horizontal position of 8A while leaving all of the cushions in their fully inflated state.

In conclusion, the combination bed/bathroom unit 10 of the present invention permits the patient to provide self-care and reduces the attention required by family members or health care providers. The present invention provides a safe, comfortable, affordable and easy to use unit which allows the individual patient to stay at home with a sense of independence and self-worth.

Although the present invention has been described with reference to preferred embodiments, workers skilled in the art will recognize that changes may be made in form and detail without departing from the spirit and scope of the invention.

What is claimed is:

1. A patient care apparatus comprising:

a tub;

a plurality of inflatable cushions positioned in the tub for supporting a patient; and means for selectively inflating and deflating the cushions for moving the patient between a plurality of positions.

2. The apparatus of claim 1 and further comprising:

a toilet having a portion positioned within the tub.

3. The apparatus of claim 2 wherein the tub has an upper body portion and a leg well portion.

4. The apparatus of claim 3 wherein the toilet has a toilet seat and a toilet opening in the upper body portion of the tub.

5. The apparatus of claim 4 and further comprising:

a toilet cover; and means for moving the toilet cover from a closed position over the seat to an open position in which the toilet seat is uncovered.

6. The apparatus of claim 5 wherein the means for moving the toilet cover comprises an air cylinder connected to the toilet cover to slide the toilet cover between the closed and open positions.

7. The apparatus of claim 6 and further comprising:
upper body platform means positioned within the tub above the upper body portion for supporting at least one of the inflatable cushions.

8. The apparatus of claim 7 wherein the open position of the toilet cover is located below the upper body platform means.

9. The apparatus of claim 8 wherein the plurality of inflatable cushions includes a seat cover cushion positioned over and connected to the toilet cover.

10. The apparatus of claim 9 wherein the plurality of inflatable cushions includes left and right hip support cushions positioned adjacent the toilet seat.

11. The apparatus of claim 10 and further comprising:
hip support platform means for supporting the left and right hip support cushions above a bottom surface of the tub.

12. The apparatus of claim 4 and further comprising:
leg support platform means positioned in the leg well region for supporting at least one of the inflatable cushions.

13. The apparatus of claim 12 and further comprising:
means for pivotally mounting the leg support platform means with respect to the tub.

14. The apparatus of claim 13 and further comprising:
means for moving the leg support platform means between raised and lowered positions.

15. The apparatus of claim 14 wherein the means for pivotally mounting defines a pivot axis for pivotal movement of the leg support platform means adjacent the toilet.

16. The apparatus of claim 12 wherein the inflatable cushions supported by the leg support platform means include at least one knee support cushion and at least one leg support cushion.

17. The apparatus of claim 16 wherein the inflatable cushions include a heel support cushion positioned at one end of the tub.

18. The apparatus of claim 1 and further comprising:
upper body platform means pivotally mounted within the tub for supporting at least one of the inflatable cushions.

19. The apparatus of claim 18 and further comprising:
drive means for pivotally moving the upper body platform means.

20. The apparatus of claim 18 wherein the upper body platform means supports left and right shoulder cushions.

21. The apparatus of claim 1 and further comprising:
a frame for supporting the tub; and
wheel means for supporting the frame.

22. The apparatus of claim 1 and further comprising:
a plurality of jets for directing fluid into the tub; and
means for selectively connecting the jets to a source of water and a source of warm air.

23. The apparatus of claim 1 and further comprising:
a sink; and
an arm pivotally supported with respect to the tub for supporting the sink.

24. A patient care apparatus comprising:
a tub having a bottom with an upper body section and a leg well section;
a toilet having a toilet opening in the upper body section of the bottom of the tub, a toilet seat surrounding the toilet opening and a toilet bowl below the bottom of the tub;
a toilet cover; and
means for moving the toilet cover from a closed position over the seat to an open position in which the toilet seat is uncovered.

25. The apparatus of claim 24 wherein the means for moving the toilet cover comprises an air cylinder connected to the toilet cover to slide the toilet cover between the closed and open positions.

26. The apparatus of claim 25 and further comprising:
upper body platform means positioned within the tub above the upper body section.

27. The apparatus of claim 26 wherein the open position of the toilet cover is located below the upper body platform means.

28. The apparatus of claim 24 and further comprising:
a plurality of inflatable cushions positioned in the tub for supporting a patient; and
means for selectively inflating and deflating the cushions for moving the patient between a plurality of positions.

29. The apparatus of claim 28 wherein the plurality of inflatable cushions includes a seat cover cushion positioned over and connected to the toilet cover.

30. The apparatus of claim 29 wherein the plurality of inflatable cushions includes left and right hip support cushions positioned adjacent the toilet seat.

31. The apparatus of claim 28 and further comprising:
leg support platform means positioned in the leg well region for supporting at least one of the inflatable cushions.

32. The apparatus of claim 31 and further comprising:
means for pivotally mounting the leg support platform means with respect to the tub.

33. The apparatus of claim 32 and further comprising:
means for moving the leg support platform means between raised and lowered positions.

34. The apparatus of claim 33 wherein the means for pivotally mounting defines a pivot axis for pivotal movement of the leg support platform means adjacent the toilet.

35. The apparatus of claim 28 and further comprising:
upper body platform means pivotally mounted within the tub for supporting at least one of the inflatable cushions.

36. The apparatus of claim 35 and further comprising:
drive means for pivotally moving the upper body platform means.

* * * * *